United States Patent [19]

Gray et al.

[11] 3,966,585

[45] June 29, 1976

[54] MANUFACTURE OF COKE FROM A COAL EXTRACT

[75] Inventors: Michael David Gray; Geoffrey Michael Kimber; David Ernest Shipley, all of Cheltenham, England

[73] Assignee: Coal Industry (Patents) Limited, London, England

[22] Filed: Nov. 26, 1974

[21] Appl. No.: 527,258

[30] Foreign Application Priority Data

Nov. 30, 1973 United Kingdom ..... 55654/73

[52] U.S. Cl. ..... 208/8; 208/131

[51] Int. Cl.[2] ..... C10G 1/04

[58] Field of Search ..... 208/8

[56] References Cited

UNITED STATES PATENTS

| | | | |
|---|---|---|---|
| 3,375,188 | 3/1968 | Bloomer | 208/8 |
| 3,503,864 | 3/1970 | Nelson | 208/8 |
| 3,505,201 | 4/1970 | Hodgson et al. | 208/8 |
| 3,505,202 | 4/1970 | Nelson | 208/8 |
| 3,607,716 | 9/1971 | Roach | 208/8 |

*Primary Examiner*—Herbert Levine

*Attorney, Agent, or Firm*—Stevens, Davis, Miller & Mosher

[57] ABSTRACT

The invention relates to a process for the production of coke having a low mineral matter content which process comprises digesting coal in a high boiling aromatic oil solvent at a temperature within the range of 350°C. to 480°C. separating insoluble matter from the coal digest to give a coal extract and coking the coal extract characterized in that the coal prior to digestion has a volatile matter content within the range of 13% to 28% by weight.

11 Claims, 1 Drawing Figure

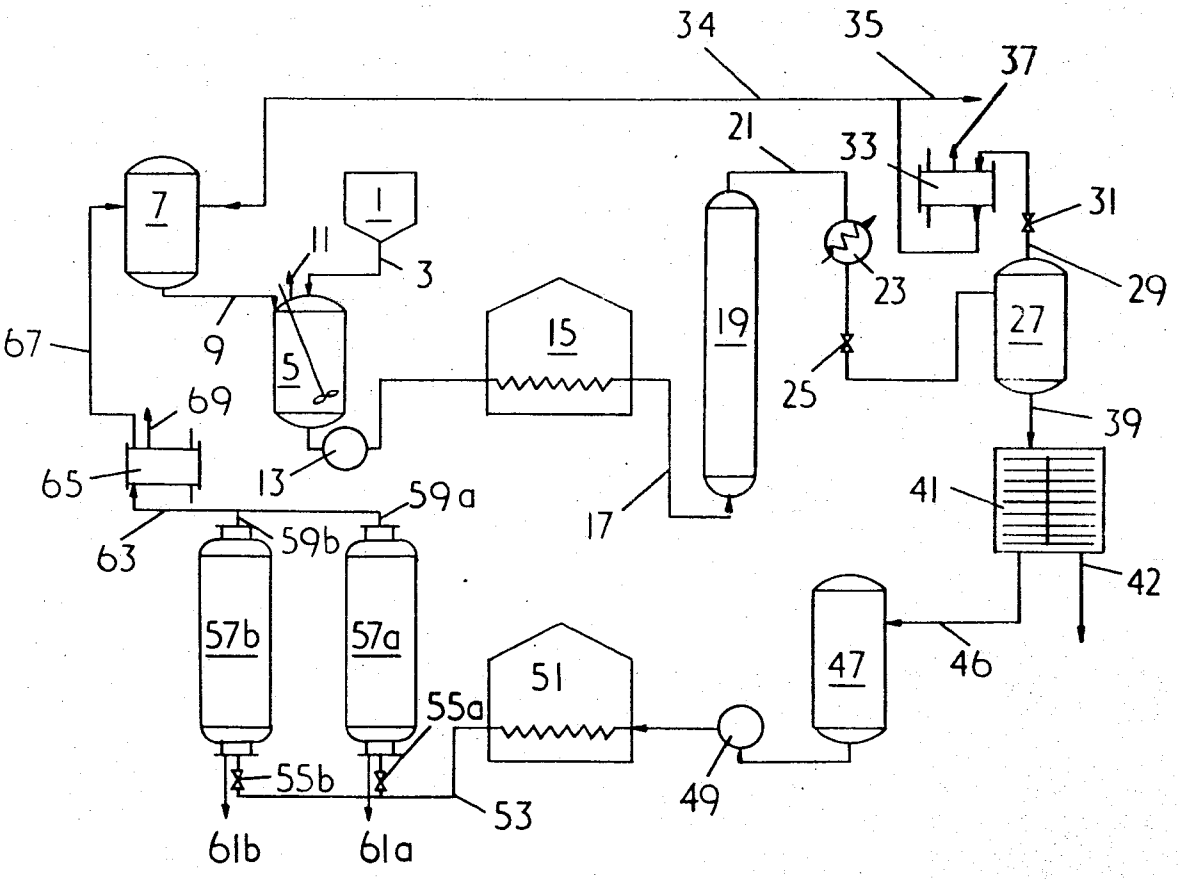
1
3
5
7
9
11
13
15
17
19
21
23
25
27
29
31
33
34
35
37
39
41
42
46
47
49
51
53
55a
55b
57a
57b
59a
59b
61a
61b
63
65
67
69

MANUFACTURE OF COKE FROM A COAL EXTRACT

This invention concerns the manufacture of coke. In particular it concerns the manufacture of a coke containing a low amount of undesirable constituents, especially mineral matter suitable for the manufacture of graphite electrodes.

Coke for the manufacture of electrodes is commonly made from bitumen feed stocks, that is the heavy fractions produced in petroleum processing, usually by delayed coking methods. These heavy fractions are decomposed producing the coke and a lighter feed stock suitable for cycling into other refinery streams. The coke produced is generally relatively low in mineral matter, compared with metallurgical coke, but may contain substantial quantities of combined sulphur, and certain other elements, for example vanadium, which it is undesirable to have in electrodes.

Carbon electrodes are widely used in aluminium smelting and in the manufacture of steel in electric arc furnaces.

There is now an increasing demand for electrode coke for use in the manufacture of electrodes in the manufacture of steel. However, the feed stocks suitable for the manufacture of the high quality grades of coke used in the manufacture of such coke that are in shortest supply.

For the manufacture of graphite electrodes for arc steel processes, the coke should generally be selected so that it is anisotropic, has needle crystallites and is graphitisable and, when made into electrodes, imparts (or contributes) in the electrode as high a resistance to thermal shock as possible, which has hitherto been generally thought to correlate with as low a coefficient of thermal expansion (CTE) as possible. The methods hereinbefore described for the production of low impurity coke from coal have not been employed to produce a high quality graphitisable anisotropic coke which imparts to an electrode a sufficiently low CTE and resistance to thermal shock so that it can be used for electric arc steel manufacture and also has a sufficiently low impurity level. It has generally hitherto been thought that such high quality coke cannot be made successfully from a coal feed-stock.

It has been proposed to digest coals in certain solvents, whereby soluble matter in the coal can be separated from unsoluble and mineral matter. The separation may be effected by filtration or centrifugation and the separated solution may then be employed as a feed stock.

Such a feed stock can, of course be subjected to delayed coking in the manner of the corresponding process as applied to petroleum feedstocks but the quality of the coke obtained has not been suitable for the manufacture of carbon electrodes particularly graphitised carbon electrodes.

Accordingly the invention provides a process for the production of a coke having a low mineral matter content comprising digesting coal in a high boiling aromatic oil solvent at a temperature within the range of 350°C. and 480°C. separating the insoluble matter from the coal digest to give a coal extract and coking the coal extract wherein a coal having a volatile matter content of between 13% and 28% is employed.

The invention further provides a process for the production of coke having a low mineral matter content which process comprises:

a. digesting the coal in a solvent, which is a high boiling aromatic oil which is a solvent for coal, at a temperature of between about 350°C. and about 480°C. for between ten minutes and about four hours whereby the coal substance is dissolved in the solvent to comprise a coal digest, said coal digest comprising solvent and coal extract in which insoluble matter from the coal and any coke formed during said digestion and dissolution is suspended, b. separating said insoluble matter from the coal and coke from the coal extract, and c. heating the separated coal extract which is substantially free from insoluble matter whereby any solvent is distilled off from the coal extract leaving residual extracted coal substance, which then decomposes to form an infusable coke.

wherein the coal has a volatile content of between 13% and 28%. The coal preferably has a volatile matter content of between 18% and 25%. The coking may be carried out in a delayed coker.

It is generally well known that the oxygen content of the coal correlates with the volatile matter content. The following table shows the values of volatile matter content corresponding approximately to values of oxygen content.

| Volatile Matter | Oxygen Content |
|---|---|
| 13 | 1.6 |
| 18 | 1.8 |
| 20 | 2.0 |
| 25 | 4.8 |
| 28 | 5.8 |
| 35 | 10.5 |

Thus, coals used in the process of the present invention may have an oxygen content of 1.6% to 5.8% by weight.

A wide variety of high boiling aromatic oil solvents may be employed in the present invention. Such solvents are known to dissolve the coal substance from the coal. The term "dissolved" as used herein in relation to coal is used in its normal sense in the art of coal chemistry, that is to say, in the sense of take into solution either as a physical dissolution, or as a result of a chemical change, molecular change or solvation. Thus, coal substance may react with molecules of the solvent. The product of such a dissolution is herein referred to as a "coal digest", although, in the art of coal chemistry, the terms "coal solution" and "coal extract" are also used. The term "coal extract" is used herein to refer to the product formed by the removal from the coal digest of insoluble matter from the coal digest.

In general, the high boiling aromatic oil solvents contained aromatic hydrocarbons as their major constituents, but a not insubstantial proportion of nitrogen and oxygen containing compounds, especially heterocyclic compounds and phenols respectively, may often be present. Because of their low boiling point, it is normal in prior processes for the manufacture of coal digests, and is referred in the present invention, to use a solvent from which the low boiling constituents particularly benzene, toluene and xylenes have been removed. The preferred solvents are formed from coal, generally from coal tars which are volatile products formed in the destructive distillation of coal, but other high boiling aromatic oils having constituents similar to tar oils may be employed. Certain petroleum oils may be employed although they are believed in general to be relatively more alkylated than the high boiling aromatic oils produced in the distillation of coal tar.

Of particular use in the process of the present invention, are the so-called "anthracene oils" although they do not necessarily contain large quantities of anthracene. The preferred anthracene oils contain substantial quantities of phenanthrenes, particularly alkylated, especially methylated, phenanthrenes. A preferred boiling range for the solvents is within the range 180°C. to 400°C. but it will often be found most convenient if the solvent has a relatively narrower boiling range, for example the middle 90% of the solvent boiling between about 250°C and 350°C. or narrower.

It is possible to employ hydrogenated aromatic compounds as at least part of the solvent. Such hydrogenated aromatic compounds include, for example, tetralin. The use of such hydrogenated aromatic compounds may however substantially increase the cost of the process.

The use of an inert atmosphere during the extraction is preferred, which inert atmosphere should not contain substantial quantities of hydrogen, which would have the effect of hydrogenating the solvent. It will, however, be understood that there may be small amounts of hydrogen produced in any event during the digestion, and such autogenic hydrogen may be present in an inert atmosphere since it has not substantial overall effect on the solvent or the coal.

The coal is preferably in particulate form when it is mixed with the solvent. The coal may be crushed and ground in conventional crushing and grinding equipment. The size of the particles of the coal is preferably such that it passes through a sieve with a 15 mm spaced mesh, but it is preferred that a smaller size be used, for example such that 90% of the coal passes through a 5 mm spaced mesh and in general the smaller the particle size the more efficient the digestion.

The coal may be mixed with the solvent in any convenient mixing equipment to form a slurry or suspension of coal in liquid solvent. The solvent may be at such a temperature, above ambient temperature, that the mixture of the coal and the solvent remains sufficiently fluid and readily transferable by generally available and simple equipment. Advantageously, the solvent is at such a temperature or sufficient heat is supplied during mixing that the mixture of the coal and the solvent is, after mixing, at above 110°C. The mixing would normally be carried out at atmosphere pressure, whereby water contained in or with the coal is vapourised. This is particularly advantageous as otherwise a large amount of water vapour may require to be heated to the digestion temperature. A desirable ratio of the solvent to the coal is between 2 to 1 to 4 to 1. The ratios that may be employed may be as low as ½ to 1 or as high as 10 to 1. High ratios of solvent to coal involve larger equipment and higher heating and like costs without necessarily obtaining a substantial return therefrom. Low ratios of solvent to coal, particularly below 2 to 1 may give rise to material transfer difficulties, particularly in the heater and the digester and during the separation, because of the high viscosity of the coal digest.

The slurry of the coal in the solvent is passed to a preheater so that is is heated rapidly to close to the temperature at which it is to be digested. It is of considerable importance to ensure that the preheating is rapid to limit the increase in viscosity of the slurry and that there is turbulent flow in the pre-heater which diminishes the tendency of the digested slurry to form coke on the surfaces of the pre-heater.

The coal is then digested for such a time at such a temperature that coal dissolves in the solvent. It is generally found that it is advisable to employ temperatures for the digestion of not less than about 350°C and the maximum temperature is in general not more than about 480°C. during the said digestion. The use of the lower temperatures will tend to render the extraction relatively slow. The coal substance extracted from the coal may not break down to a sufficient extent if the digestion temperature is too low. Furthermore, it is often found that the extraction products may not be so suitable for use in the manufacture of coke if too low an extraction temperature is employed. If the digestion temperature is too high, the extracted coal substance will decompose to form a coke. This may be undesirable as coke formed during the digestion will be filtered off with the mineral matter and will not appear as a useful yield of coke.

As a general rule it has been found that the lower the volatile matter content (or other parameter correlating with the volatile matter content as is herein described) of the coal the higher the temperature it is desirable to use during the digestion.

As a general guide to the time of digestion, a digestion time of 2 hours is desirable, and a minimum digestion time of 30 minutes is convenient. However, longer or shorter times may be employed if necessary or undesirable. One major factor in the consideration of the times of the digestion is that larger equipment may be needed if longer retention time in the digester is required.

The coal digest is then advantageously cooled and transferred to a flash tank so that any gases and the more volatile constituents of the coal digest may be volatilised and removed before separation. The volatile constituents may not necessarily have been included in the original solvent used to digest the coal but may have been formed, for example by decomposition or disproportionation or hydrogenation of the coal or of the solvent or both, during the digestion. The heavier portion at least of such volatile constituents may be recycled to be included in the solvent for further digestion. However, this may depend on solvent requirements and recycleable solvent yields in individual cases, and experimentation will be necessary in order to determine material, particularly solvent recycle, balances for the overall process. For filtration, it will generally be found advantageous to ensure that the coal digest is between about 170°C and 300°C. At temperatures below about 170°C, it will generally be found that the viscosity of the coal extract may be so high as to make separation slow. At temperatures above about 300°C the nature of the coal digest and, in particular, its corrosiveness, is such as to be liable to give a lower life to the equipment while not contributing substantially by way of increasing the rate of separation. A general guide is that a separation temperature between about 200°C and 250°C is most suitable. The most suitable separation temperature will depend, inter alia, on the solvent employed, for example if a tar is employed rather than a tar oil, the viscosity of the tar at any temperature will be higher than than the viscosity of the tar oil and to obtain an equivalent viscosity a higher temperature of separation may require to be used. Additionally, the separation temperature employed will depend on the ratio of the solvent to the coal. As has heretofore been mentioned, the lower the ratio of the solvent to the coal, the higher the viscosity of both the coal digest and coal extract at any particular temperature and the more difficult it may be to filter. However, it may be possible to improve the separation if, for any particular reason, it is desired to employ relatively low ratios of solvent to coal during the digestion by adding relatively mobile liquid solvent, preferably aromatic, to dissolve the coal extract.

Any convenient method of separating the insoluble constituents of the coal digest suspended in the coal extract may be employed. It will generally be found necessary to employ filtration in order to separate sufficient of the particles from the coal extract. However, it may be advisable initially to subject the coal digest to a centrifugation process, or other sedimentation process, in order to achieve a preliminary separation. Under suitable circumstances a centrifugation process will suffice, without subseqent filtration.

It is believed that the particles, particularly the larger particles remaining in the coal extract, may affect the coking of the coal extract to the extent that the particles act as nuclei on which the coke may form. This may give rise to amorphous cokes or other undesirable crystalline forms. Accordingly it is preferred that the sizes of the particles in the coal extract after the insoluble matter in the coal digest has been separated therefrom is such that, calculated as a percentage by weight basis, relative to the final yield of the coke product, less than 2.5% in the coal extract comprises particles that have a particle size greater than one micron. Preferably less than 1% in the coal extract comprises particles having a particle size of greater than one micron. Such particles are not necessarily mineral matter and may be coke formed during the digestion.

The coal extract is then coked, preferably in a delayed coker. In the formation of coke, molecules containing carbon and hydrogen condense to form extended, cross-linked chains (i.e. polymerise) whereby smaller molecules are eliminated. The chains gradually are extended and cross-linked by thermal action until a solid infusible insoluble mass of coke is formed. The coke has a higher carbon to hydrogen atomic ratio than does the original material, which may be considered as disproportionating in the formation of the coke and the lower molecular weight compounds. As the temperature of the coke is raised, more hydrogen and other elements are eliminated until the coke consists essentially of carbon and non-volatilisable mineral matter constituents, the latter often in the form of oxides, although much of this may volatilise at temperatures of the order of 2800°C to 3100°C which are often used for forming graphites. This may occur at temperatures in the general range 1600°C to 2600°C. Such elements other than carbon may be removed by special techniques. For example boron, which is contained in the coal substance as being included in the plant material from which the coal was formed, may be removed by reaction of the coke with fluorine or fluorine compounds. Certain other elements may be at least partially removed by other techniques, if necessary.

The coke may then be converted into a graphite by heating, in an inert atmosphere, at graphitising temperatures, for example 2600°C to 3000°C. It will be understood from the foregoing that the extent of the disproportionation will vary with temperature, the coke formed at (or heated to) a higher temperature having a higher proportion of carbon and a lower volatile matter content than a coke formd at (or heated to) a lower temperature.

The various methods of forming coke require the coal extract to be heated to a temperature at which the coal extract decomposes so that a coke is formed. There are a variety of heating methods and equipment that can be employed in the invention. The basic factors required are that the coal extract be heated to such a temperature and for such a time to disproportionate into a coke and other conpounds. The method of coking employed will influence the kind of coke produced. However, it is believed that whatever method is employed, the present invention will produce an improved coke, imparting a lower CTE and resistance to thermal shock to electrodes, than the use of other coals, having higher volatile matter contents. One method of forming coke is by means of a contact coking apparatus, which in essence comprises a reactor having a downwardly moving bed of particles onto which the material to be coked is fed and on the surface of which the coke is formed. Alternatively the material to be coked may be fed into a fluidised bed of particles onto the surface of which the coke is formed. In both these cases, the particle shape is spherical rather than needle shaped crystallites and onion-like layers of coke are formed. A further method that can be employed is by placing the material to be coked in an oven and heating it.

It is preferred however that the coking is carried out by the delayed coking method whereby the material to be coked is heated to a temperature above that at which, if maintained at that temperature, a coke will be formed. The material to be coked is then introduced into a coking drum. In normal practice this is a drum, generally lagged but unheated, in which the feedstock material to be coked disproportionates to form the coke. Advantageously, the feedstock is introduced at a relatively high temperature so that coke is formed rapidly. As a general guide temperatures within the range 450°C. to 550°C maybe employed while temperatures greater than about 480°C are preferred. In general, it will be necessary to employ a higher temperature with the less reactive coals, which reactivity generally correlates with the volatile matter content. A coal of volatile matter content 22% may require a temperature for coking of as high as 530°C.

The material that is actually coked may be the coal extract or it may be coal extract from which at least a portion of the volatile matter, including solvent, has been removed. The coal extract may alternatively have added to it a further amount of solvent. This addition may be particularly advantageous in delayed coking.

The invention will now be described with reference to the accompanying drawing which shows an apparatus suitable for use in carrying out the process of the invention on an industrial scale. The drawing is of a schematic nature, and it is to be understood that, in a commercial plant, additional equipment would be provided including, for example, heat exchangers to ensure, in so far as is possible, the recovery of waste heat.

The coal, of such a size that it passes through a sieve with a 5mm spaced mesh, is introduced from coal hopper 1 through feed line 3 into a stirred mixing tank 5. Solvent, typically anthracene oils at about 120°C and atmoshpheric pressure is introduced from hold tank 7 through feed line 9 into the stirred mixing tank 5. The stirred mixing tank 5 is advantageously heated by heating means (now shown) so that the temperature of the contents of the stirred mixing tank 5 is maintained at about 120°C. This has the effect that any water contained in or with the coal evaporates and is vented as steam through vent pipe 11. The coal and the solvent are fed into stirred mixing tank 5 in appropriate ratios, typically between 2 parts and 4 parts by weight of oil for each part of coal. The slurry formed in the stirred mixing tank 5 is pumped therefrom by metering pump 13 through pre-heater 15 whereby turbulent flow is induced in the pre-heater, so that the slurry of coal and solvent has a retention time in the pre-heater of between 10 seconds and 200 seconds, during which time it is heated to about 400°C to 420°C and then fed through feed pipe 17 into digester 19. The pressure in the digester 19 is sufficiently high that the solvent is maintained in a substantially liquid phase. Cases may however be formed in reactions, solvolytic or otherwise, in the digester 19 or by the volatilisation of small quantities of water. Typically the pressure in the digester 19 is about 6 atmospheres, but higher pressures, for example up to 15 atmospheres, or lower pressures, for example as low as two atmospheres, may be employed in appropriate cases. The pressure generated by the metering pump 13 for this purpose may typically be of the order of 10 atmospheres to 25 atmospheres, but this must not be taken as a limitative indication and the skilled chemical engineer will require, as is normal chemical engineering practice, to calculate pressures and pressure losses particularly through pipework in individual cases. The coal is retained in the digester 19 for sufficient time for the solvent to dissolve coal substance from the coal, such time, typically, being about 30 minutes, but it is to be understood that times may be shorter than this in particular cases, particularly depending on the temperature of the slurry in the digester 19. The coal digest thereby formed is passed from the digester 19 through feed line 21 a heat exchanger 23 in which it is cooled to about 200°C and then through a pressure reducing valve 25, which allows the pressure of the coal digest to diminish, typically to 3 atmospheres, although pressures of between 4 atmospheres and 0.5 atmospheres may be employed. The coal digest is then fed into a flask tank 27, in which the gases and other relatively volatile compounds formed during the digestion, or pre-existing in the solvent, are allowed to flash off and are removed as vapours through vent line 29 and reducing valve 31 and are then fed to a condenser 33, which operates at atmospheric pressure so as to condense light oils therefrom which are then passed through transfer line 34 into hold tank 7, for re-use. Alternatively the light oils or a portion thereof may be taken off through product line 35 for fractionation or other uses. The uncondensed gases are removed through vent line 37. The uncondensed gases may often be burnt to provide process heat. The coal digest is removed from flash tank 27 through transfer line 39 into filter 41. The filter 41 will operate with a pressure differential of typically about 4 atmospheres. In the filter 41 the portion of the coal and the mineral matter that is insoluble in the solvent is filtered off and the filter cake is removed from the filter 41 through removal line 42. The filtered coal extract is removed from filter 41, typically at about 200°C through transfer line 46 into hold tank 47.

The coal extract is removed from hold tank 47 and is pressurised by pump 49 to about 14 atmospheres pressure and through pre-heater 51 in which it has a retention time of up to about 100 seconds and in which it is heated from 200°C to a temperature, typically about 510°C, which latter temperature is above the coking temperature of the extracted coal substance, and emerges at a pressure which is typically up to about 4 atmospheres, although pressures of between atmospheric pressure and 10 atmospheres may conveniently be employed with suitable equipment. The coal extract is transferred from the pre-heater 51 through transfer line 53 and alternative coking drum feed valves 55*a* and 55*b* to one of two coking drums 57*a* and 57*b*. Only one of the two coking drums 57*a* and 57*b* are employed at any one time. The coking frums 57*a* and 57*b* are vertical cylinders as in normal delayed coking practice and are lagged and may be provided with heaters to diminish lowering temperature by heat loss. The coal extract is introduced into the coking drum 57 at the bottom portion thereof and, at the temperature of 500°C, the majority of the solvent flashes of rapidly through gas removal vent pipes 59*a*, 59*b* at the top of the two coking drums 57*a* and 57*b* leaving behind a residual liquid which is mainly the coal substance which was extracted into the solvent in the digester 19, but includes solvolytically attacked coal substance and solvent residues therein. At the temperature 500°C, the coal substance, which is fluid at that temperature, commences to form a coke which forms in the bottom of the coking drum 57. As more coal extract is introduced into the coking drum 57 the coal substance cokes and the coke builds up in the coking drum 57 until the coking drum 57 is filled. The gases and vapours fromed by disproportionation of the coal substance in the formation of the coke are removed through as removal vent pipes 59*a* and 59*b*. When one of the coking drums is full, the feed from the pre-heater 51 through feed line 53 is switched by means of the coking drum feed valves 55*a* and 55*b* into the other coking drums 57*a* and 57*b*. The coke formed in the filled coking drum 57*a* or 57*b* is then removed in accordance with the methods employed generally in delayed coking practice through coke removal lines 61*a* or 61*b*. It will be understood by those of skill in the art of delayed coking that there are other steps necessary in the delayed coking cycle, for example it is necessary to cool the coke before it is removed from the coking drum 57*a* or 57*b* generally by means of steam and/or water fed into the coking drum 57*a* or 57*b* and feed pipes (which are not shown) and vent pipes (which are not shown) and other requisite ancillary equipment should be provided and used. It will be advisable to pre-heat the coking drum 57*a* or 57*b* before coal extract is introduced into it, for example by the passage of the gases or vapours from the gas removal vents 59. Suitable piping (not shown) is provided for this purpose. However, these are techniques that are in themselves well known to those of skill in the delayed coking art in relation to the delayed coking of petroleum bitumen and the like.

The gases and vapours that are produced in the coking drum 57*a* and 57*b* are removed therefrom through gas removal vents 59*a* and 59*b* and passed through gas transfer line 63 to a condenser 65. The solvent and other vapours are condensed in the condenser 65 and passed through transfer line 67 to hold tak 7 for recycling. The uncondensed gases are removed through vent line 69, and may be burnt to provide process heat.

Following is a description by way of example only of methods of carrying the invention into effect.

EXAMPLE 1

Coal from Bynon mine of 24% volatile matter and 2.6% oxygen content was mixed with 4 parts of an oil recycled from a process according to this invention, which was originally a drained anthracene oil, which recycled oil had a 5% to 95% boiling range of 250° ± 20°C to 390° ± 15°C. The mixture was digested at 4 atmospheres pressure and 400°C for one hour. The coal digest was cooled, filtered at 250°C, and the coal extract was introduced into a reactor and heated at 50°C per hour up to 500°C to produce a coke. The pressure in the reactor was atmospheric. The coke so formed was calcined at 1300°C. The calcined coke was included in a synthetic graphite electrode. The electrode had a CTE of $7 \times 10^{-7}$/°C. The electrode had an excellent resistance to thermal shock as determined by normal thermal shock cycle tests.

EXAMPLE 2

A further coal from Bynon mine of 24% volatile matter content and a 3% oxygen content was mixed with the same oil and at the same ratio as in Example 1 and the mixture was introduced into a continuous preheater in which it was heated to 400°C and then into a continuous digester in which it had a pressure of 5 atmospheres and a residence time of about 1½ hours. The coal digest was cooled continuously to 200°C, and filtered. The coal extract was introduced into a heater in which it was heated in less than 2 minutes to 500°C and then injected into a delayed coking drum which had been pre-heated to 500°C. The coke produced was calcined at 1300°C and had an excellent needle crystallite structure. When included in a synthetic graphite electrode, the electrode had a coefficient of thermal expansion of $7 \times 10^{-7}$/°C and an excellent resistance to thermal shock.

COMPARATIVE EXAMPLE

Coal from Annesley mine having a volatile matter content of 39% and an oxygen content of 8% was treated in exactly the same way as in Example 1 above. The resulting synthetic graphite electrode had a coefficient of thermal expansion of $45 \times 10^{-7}$/°C and poor resistance to thermal shock.

All analyses, including volatile matter contents, of coal, but not of coke, in this specification are on a dry, mineral-matter free basis, as provided by and according to methods of British Standard 1016, unless the contrary is explicitly stated. Oxygen contents, however, are determined by direct method of I.S.O. standard R 1994 of November 1971.

All pressures are gauge pressures, except that atmospheric pressure is ambient pressure.

We claim:

1. A process for the production of coke having a low mineral matter content which process comprises digesting coal in a non-hydrogenated high boiling aromatic oil solvent at a temperature within the range of 350°C. to 480°C. in an atmosphere which is substantially free from hydrogen separating insoluble matter from the coal digest to give a coal extract and coking the coal extract characterised in that all the coal prior to digestion has a volatile matter content within the range of 13% to 28% by weight.

2. A process for the production of coke having a low mineral matter content which process comprises digesting coal in a solvent which solvent is a non-hydrogenated high boiling aromatic oil which is a solvent for the coal at a temperature between 350°C and 480°C. in an atmosphere which is substantially free from hydrogen for a period of between 10 minutes to 4 hours, to dissolve the coal substance to form a coal digest comprising solvent and coal extract in which insoluble matter from the coal and any coke formed during the digestion is suspended, separating the suspended and insoluble matter from the digest, heating the separated digest which is substantially free from insoluble matter to distill off the solvent leaving a residual coal extract and thereafter coking the coal extract characterised in that all the coal prior to digestion has a volatile matter content of 13% to 28% by weight.

3. A process as claimed in claim 1 characterised in that the coal has a volatile matter content of between 18% and 25% by weight.

4. A process as claimed in claim 1 characterised in that the coking of the coal extract is carried out in a delayed coker.

5. A process as claimed in claim 1 characterised in that the coal has an oxygen content of 1.6% to 5.8% by weight.

6. A process as claimed in claim 1 wherein the aromatic oil solvents are formed from coal, coal tar derivatives, and from petroleum oil derivatives.

7. A process claimed in claim 6 characterised in that wherein the solvent is an anthracene oil.

8. A process as claimed in claim 1 characterised in that wherein the solvent oil has a boiling range within the range of 180°C. to 400°C.

9. A process as claimed in claim 1 characterised in that the middle 90% of the solvent has a boiling range within the range 250°C. to 350°C.

10. A process as claimed in claim 1 characterised in that the separation of the insoluble material from the digest is carried out by filtration at a temperature within the range 150°C. to 300°C. additional solvent being added prior to filtration to reduce the viscosity during the filtration step.

11. In a process for making coke adapted to be used for making graphite electrodes wherein coal is mixed with a non-hydrogenated high boiling aromatic oil solvent for cokable substances in the coal, digesting the resulting mixture at a temperature of 350°C. to 480°C. in an atmosphere which is substantially free from hydrogen until cokable substances are dissolved, separating the resulting liquid and solid phases, removing the solvent from the liquid phase and thereafter coking the resulting coal extract, the improvement which comprises mixing with said aromatic oil only coal having a volatile content of 13% to 28% by weight.

* * * * *